US010434372B2

(12) United States Patent
Sajima et al.

(10) Patent No.: US 10,434,372 B2
(45) Date of Patent: Oct. 8, 2019

(54) TWO-PIECE GOLF BALL

(71) Applicant: DUNLOP SPORTS CO. LTD., Kobe-shi, Hyogo (JP)

(72) Inventors: Takahiro Sajima, Kobe (JP); Hironori Takihara, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/353,864

(22) Filed: Nov. 17, 2016

(65) Prior Publication Data

US 2017/0173400 A1 Jun. 22, 2017

(30) Foreign Application Priority Data

Dec. 16, 2015 (JP) ..... 2015-244734

(51) Int. Cl.
*A63B 37/00* (2006.01)
*A63B 45/00* (2006.01)

(52) U.S. Cl.
CPC ..... *A63B 37/0074* (2013.01); *A63B 37/0012* (2013.01); *A63B 37/0017* (2013.01); *A63B 37/0018* (2013.01); *A63B 37/0019* (2013.01); *A63B 37/0021* (2013.01); *A63B 37/0033* (2013.01); *A63B 37/0065* (2013.01); *A63B 37/0087* (2013.01); *A63B 45/00* (2013.01); *A63B 37/0031* (2013.01); *A63B 37/0032* (2013.01); *A63B 37/0062* (2013.01); *A63B 37/0063* (2013.01); *A63B 2037/0079* (2013.01)

(58) Field of Classification Search
CPC ..... A63B 37/0004; A63B 37/0006; A63B 37/0065; A63B 37/0074
See application file for complete search history.

(56) References Cited

U.S. PATENT DOCUMENTS

| | | | | |
|---|---|---|---|---|
| 5,072,945 | A * | 12/1991 | Oka | A63B 37/0004 40/327 |
| 5,304,608 | A | 4/1994 | Yabuki et al. | |
| 2003/0050138 | A1* | 3/2003 | Kasashima | A63B 37/0004 473/384 |
| 2003/0119606 | A1* | 6/2003 | Ohama | A63B 37/0003 473/371 |
| 2005/0130768 | A1* | 6/2005 | Yokota | A63B 37/0004 473/378 |
| 2009/0209367 | A1* | 8/2009 | Stefan | A63B 37/0004 473/373 |

(Continued)

*Primary Examiner* — John E Simms, Jr.
(74) *Attorney, Agent, or Firm* — Birch, Stewart, Kolasch & Birch, LLP

(57) ABSTRACT

A golf ball 2 includes a core 4 and a cover 6. An amount of compressive deformation Df of the core 4 is equal to or greater than 4.1 mm. A nominal thickness T of the cover 6 is equal to or less than 1.70 mm. The golf ball 2 has a plurality of dimples 8 on a surface thereof. A value V calculated by the following mathematical formula is equal to or less than 290.

$$V=N*So/Bb$$

In the mathematical formula, N represents a total number of the dimples 8, So represents a ratio of a total area of all the dimples 8 relative to a surface area of a phantom sphere of the golf ball 2, and Bb represents an average (mm) of thicknesses B of the cover 6 immediately below deepest points of the dimples 8.

6 Claims, 17 Drawing Sheets

(56) References Cited

U.S. PATENT DOCUMENTS

| | | | | |
|---|---|---|---|---|
| 2010/0298070 | A1* | 11/2010 | Higuchi | A63B 37/0004 473/384 |
| 2012/0277020 | A1* | 11/2012 | Higuchi | C08K 5/09 473/280 |
| 2012/0277024 | A1* | 11/2012 | Higuchi | A63B 69/3655 473/280 |
| 2013/0095955 | A1* | 4/2013 | Higuchi | A63B 37/0054 473/372 |
| 2013/0172108 | A1* | 7/2013 | Higuchi | A63B 37/0065 473/372 |
| 2014/0073455 | A1* | 3/2014 | Ozawa | A63B 37/0012 473/372 |

* cited by examiner

TWO-PIECE GOLF BALL

This application claims priority on Patent Application No. 2015-244734 filed in JAPAN on Dec. 16, 2015. The entire contents of this Japanese Patent Application are hereby incorporated by reference.

BACKGROUND OF THE INVENTION

Field of the Invention

The present invention relates to golf balls.

Specifically, the present invention relates to so-called two-piece golf balls including a core and a cover.

Description of the Related Art

Upon an accurate shot, a golf ball is hit at the sweet spot of a clubface. The shock generated by this shot is small. Upon a mishit, a golf ball is hit at a portion of a clubface other than the sweet spot. The shock upon the mishit is large. The large shock gives pain to the golf player. At this time, the golf player feels discomfort. Particularly, upon a mishit made when the temperature is low (for example, in winter), a golf player feels a sharp pain.

Golf players generally desire golf balls having favorable feel at impact. Particularly, beginners prefer soft feel at impact. This is because the frequency of a mishit is high in play by beginners.

So-called thread-wound balls used to be mainstream golf balls. At present, thread-wound balls are almost not available commercially. In recent golf, two-piece balls, three-piece balls, four-piece balls, five-piece balls, six-piece balls, and the like are used.

A two-piece ball includes a core and a cover. The structure of the two-piece ball is simple. The two-piece ball can be manufactured at low cost. A proposal concerning two-piece balls is disclosed in JPH5-123422 (U.S. Pat. No. 5,304,608).

Upon shots by beginners, golf balls often fly in an unintended direction. Golf balls often fall into a pond or fly into woods. Beginners often loose golf balls. Therefore, beginners do not prefer expensive golf balls. Two-piece balls are suitable for beginners, since two-piece balls can be manufactured at low cost. As descried above, beginners prefer soft feel at impact. Improvement of feel at impact of two-piece balls is desired.

With a two-piece ball in which a core having a large amount of deformation upon hitting is adopted, soft feel at impact can be achieved. However, in this golf ball, a cover thereof cannot follow deformation of the core. Large deformation of the core causes breakage of the cover. The durability of the two-piece ball in which this core is adopted is not good.

An object of the present invention is to provide a two-piece golf ball having excellent feel at impact and excellent durability.

SUMMARY OF THE INVENTION

A two-piece golf ball according to the present invention includes a core and a cover positioned outside the core. An amount of compressive deformation Df of the core is equal to or greater than 4.1 mm. A nominal thickness T of the cover is equal to or less than 1.70 mm. The golf ball has a plurality of dimples on a surface thereof. In the golf ball, a value V calculated by the following mathematical formula is equal to or less than 290.

$$V=N*So/Bb$$

In the mathematical formula, N represents a total number of the dimples, So represents a ratio of a total area of all the dimples relative to a surface area of a phantom sphere of the golf ball, and Bb represents an average (mm) of thicknesses B of the cover immediately below deepest points of the dimples.

The golf ball according to the present invention includes the core having a large amount of compressive deformation Df, and the cover that is thin. Therefore, when the golf ball is hit, the feel at impact is soft. Since the value V is equal to or less than 290, the golf ball is less likely to break. The golf ball has both excellent feel at impact and excellent durability.

Preferably, in the golf ball, an average Bp of the thicknesses B at the dimples that are present in a zone in which a latitude is equal to or greater than 30° is larger than an average Bs of the thicknesses B at the dimples that are present in a zone in which the latitude is less than 30°. Preferably, a difference (Bp−Bs) between the average Bp and the average Bs is equal to or greater than 0.010 mm.

Preferably, a product (T*H) of the nominal thickness T (mm) and a Shore C hardness H of the cover is equal to or less than 150.

Preferably, a Shore C hardness C0 at a central point of the core, a Shore C hardness C1 at a surface of the core, and the Shore C hardness H of the cover meet the following mathematical formulas (1), (2), and (3).

$$C1\geq 70 \quad (1)$$

$$C1-C0\geq 10 \quad (2)$$

$$0\leq H-C1\leq 20 \quad (3)$$

A manufacturing method for a golf ball according to the present invention includes: the steps of:

placing a core into a mold having a plurality of pimples on a cavity face thereof;

holding the core at a center of a cavity by a plurality of pins projecting from a vicinity of each pole of the cavity face;

injecting a melted resin composition from a plurality of gates located near an equator of the cavity, toward a space between the cavity face and the core;

causing the pins to retract to positions at which leading ends thereof substantially coincide with the cavity face;

filling spaces occurring due to the retraction of the pins, with the resin composition; and forming a cover by solidification of the resin composition, to form a plurality of dimples having a shape that is an inverted shape of the pimples, on the cover, wherein an average Bp of thicknesses B of the cover immediately below deepest points of the dimples that are present in a zone in which a latitude is equal to or greater than 30° is larger than an average Bs of thicknesses B of the cover immediately below deepest points of the dimples that are present in a zone in which the latitude is less than 30°.

Preferably, the number of the gates in the mold is equal to or greater than 12.

DESCRIPTION OF THE PREFERRED EMBODIMENTS

The following will describe in detail the present invention based on preferred embodiments with appropriate reference to the drawings.

Figure 1:
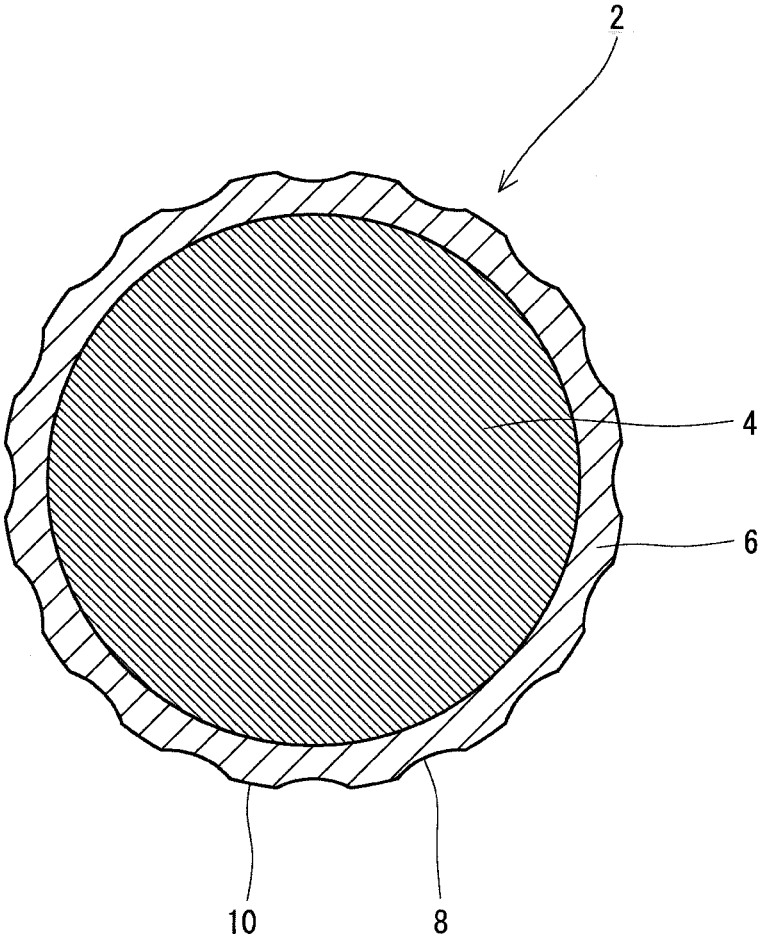
FIG. 1 is a cross-sectional view of a golf ball according to one embodiment of the present invention.

A golf ball 2 shown in FIG. 1 includes a spherical core 4 and a cover 6 positioned outside the core 4. In the present embodiment, the cover 6 is joined directly to the core 4. The golf ball 2 is a so-called two-piece ball. The golf ball 2 has a plurality of dimples 8 on the surface thereof. Of the surface of the golf ball 2, a part other than the dimples 8 is a land 10. The golf ball 2 includes a paint layer and a mark layer on the external side of the cover 6 although these layers are not shown in the drawing.

The golf ball 2 preferably has a diameter of equal to or greater than 40 mm but equal to or less than 45 mm. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 preferably has a weight of equal to or greater than 40 g but equal to or less than 50 g. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferable. When a polybutadiene and another rubber are used in combination, it is preferred if the polybutadiene is a principal component. Specifically, the proportion of the polybutadiene to the entire base rubber is preferably equal to or greater than 50% by weight and particularly preferably equal to or greater than 80% by weight. A polybutadiene in which the proportion of cis-1,4 bonds is equal to or greater than 80% is particularly preferable.

The rubber composition of the core 4 preferably includes a co-crosslinking agent. Preferable co-crosslinking agents in light of durability and resilience performance of the golf ball 2 are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. In light of durability and resilience performance of the golf ball 2, zinc acrylate and zinc methacrylate are particularly preferable.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

The amount of the co-crosslinking agent per 100 parts by weight of the base rubber is preferably equal to or greater than 10 parts by weight. The amount of deformation of the core 4 in which this amount is equal to or greater than 10 parts by weight, when the golf ball 2 is hit, is not excessive. With the golf ball 2 including the core 4, the cover 6 is less likely to break. The golf ball 2 including the core 4 also has excellent resilience performance. In these respects, this amount is more preferably equal to or greater than 15 parts by weight and particularly preferably equal to or greater than 20 parts by weight.

The amount of the co-crosslinking agent per 100 parts by weight of the base rubber is preferably equal to or less than 40 parts by weight. The core 4 in which this amount is equal to or less than 40 parts by weight sufficiently deforms when the golf ball 2 is hit. Because of the core 4, soft feel at impact of the golf ball 2 can be achieved. In this respect, this amount is more preferably equal to or less than 35 parts by weight and particularly preferably equal to or less than 30 parts by weight.

Preferably, the rubber composition of the core 4 includes an organic peroxide. The organic peroxide serves as a crosslinking initiator. The organic peroxide contributes to the durability and the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

The amount of the organic peroxide per 100 parts by weight of the base rubber is preferably equal to or greater than 0.1 parts by weight. The amount of deformation of the core 4 in which this amount is equal to or greater than 0.1 parts by weight, when the golf ball 2 is hit, is not excessive. With the golf ball 2 including the core 4, the cover 6 is less likely to break. The golf ball 2 including the core 4 also has excellent resilience performance. In these respects, this amount is more preferably equal to or greater than 0.3 parts by weight and particularly preferably equal to or greater than 0.5 parts by weight.

The amount of the organic peroxide per 100 parts by weight of the base rubber is preferably equal to or less than 3.0 parts by weight. The core 4 in which this amount is equal to or less than 3.0 parts by weight sufficiently deforms when the golf ball 2 is hit. Because of the core 4, soft feel at impact of the golf ball 2 can be achieved. In this respect, this amount is more preferably equal to or less than 2.5 parts by weight and particularly preferably equal to or less than 2.0 parts by weight.

The rubber composition of the core 4 may include a filler for the purpose of specific gravity adjustment and the like. Examples of suitable fillers include zinc oxide, barium sulfate, calcium carbonate, and magnesium carbonate. The amount of the filler is determined as appropriate so that the intended specific gravity of the core 4 is accomplished. The rubber composition may include various additives, such as sulfur, an organic sulfur compound, a carboxylic acid, a carboxylate, an anti-aging agent, a coloring agent, a plasticizer, a dispersant, and the like, in an adequate amount. The rubber composition may include crosslinked rubber powder or synthetic resin powder.

The core 4 preferably has a diameter of equal to or greater than 39.0 mm. In the golf ball 2 that includes the core 4 having a diameter of equal to or greater than 39.0 mm, the cover 6 is thin. Therefore, the golf ball 2 has excellent feel at impact. Furthermore, the golf ball 2 has excellent resilience performance. In these respects, the diameter is more preferably equal to or greater than 39.3 mm and particularly preferably equal to or greater than 39.8 mm. In light of durability of the golf ball 2, the diameter is preferably equal to or less than 41.0 mm, more preferably equal to or less than 40.6 mm, and particularly preferably equal to or less than 40.2 mm.

The core 4 preferably has an amount of compressive deformation Df of equal to or greater than 4.1 mm. The core 4 having an amount of compressive deformation Df of equal to or greater than 4.1 mm sufficiently deforms when the golf ball 2 is hit. Because of the core 4, soft feel at impact of the golf ball 2 can be achieved. In this respect, the amount of compressive deformation Df is more preferably equal to or greater than 4.2 mm and particularly preferably equal to or greater than 4.4 mm. In light of resilience performance of the golf ball 2, the amount of compressive deformation Df is preferably equal to or less than 6.5 mm, more preferably equal to or less than 6.0 mm, and particularly preferably equal to or less than 5.5 mm.

For measurement of the amount of compressive deformation DF, a YAMADA type compression tester is used. In the tester, the core 4 is placed on a hard plate made of metal. Next, a cylinder made of metal gradually descends toward the core 4. The core 4, squeezed between the bottom face of the cylinder and the hard plate, becomes deformed. A migration distance of the cylinder, starting from the state in which an initial load of 98 N is applied to the core 4 up to the state in which a final load of 1274 N is applied thereto, is measured. A moving speed of the cylinder until the initial load is applied is 0.83 mm/s. A moving speed of the cylinder after the initial load is applied until the final load is applied is 1.67 mm/s.

The golf ball 2 meets the following mathematical formula (2).

$$C1-C0 \geq 10 \quad (2)$$

In this mathematical formula, C0 represents a hardness at the central point of the core 4, and C1 represents a hardness at the surface of the core 4. The core 4 that meets the mathematical formula (2) has a so-called outer-hard/inner-soft structure. When the golf ball 2 including the core 4 is hit with a driver, the spin is suppressed. When the golf ball 2 including the core 4 is hit with a driver, a high launch angle is obtained.

Upon a shot with a driver, an appropriate trajectory height and appropriate flight duration are required. With the golf ball 2 that achieves a desired trajectory height and desired flight duration at a high spin rate, the run after landing is short. With the golf ball 2 that achieves a desired trajectory height and desired flight duration at a high launch angle, the run after landing is long. In light of flight distance, the golf ball 2 that achieves a desired trajectory height and desired flight duration at a high launch angle is preferable. The core 4 having an outer-hard/inner-soft structure can contribute to a high launch angle and a low spin rate as described above. Although the amount of compressive deformation Df is small, the core 4 can contribute to the flight performance of the golf ball 2.

In light of flight performance, the difference (C1−C0) is more preferably equal to or greater than 11 and particularly preferably equal to or greater than 12. In light of durability of the golf ball 2, the difference (C1−C0) is preferably equal to or less than 30, more preferably equal to or less than 28, and particularly preferably equal to or less than 25.

In light of durability and resilience performance, the central hardness C0 is preferably equal to or greater than 40, more preferably equal to or greater than 45, and particularly preferably equal to or greater than 50. In light of spin suppression, the hardness C0 is preferably equal to or less than 70, more preferably equal to or less than 65, and particularly preferably equal to or less than 60.

The hardness C0 is measured with a Shore C type hardness scale mounted to an automated hardness meter (trade name "digi test II" manufactured by Heinrich Bareiss Prüfgerätebau GmbH). The hardness scale is pressed against the central point of the cross-section of a hemisphere obtained by cutting the golf ball 2. The measurement is conducted in the environment of 23° C.

In light of spin suppression, the surface hardness C1 is preferably equal to or greater than 66, more preferably equal to or greater than 68, and particularly preferably equal to or greater than 70. In other words, the golf ball 2 that meets the following mathematical formula (1) is particularly preferable.

$$C1 \geq 70 \quad (1)$$

In light of durability of the golf ball 2, the hardness C1 is preferably equal to or less than 85, more preferably equal to or less than 83, and particularly preferably equal to or less than 80.

The hardness C1 is measured with a Shore C type hardness scale mounted to an automated hardness meter (trade name "digi test II" manufactured by Heinrich Bareiss Prüfgerätebau GmbH). The hardness scale is pressed against the surface of the core 4. The measurement is conducted in the environment of 23° C.

The core 4 preferably has a weight of equal to or greater than 10 g but equal to or less than 42 g. The temperature for crosslinking the core 4 is equal to or higher than 140° C. but equal to or lower than 180° C. The time period for crosslinking the core 4 is equal to or longer than 10 minutes but equal to or shorter than 60 minutes.

The cover 6 is positioned outside the core 4. The cover 6 is the outermost layer except the mark layer and the paint layer. The cover 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 that includes the cover 6 including an ionomer resin has excellent resilience performance. The cover 6 may be formed from a thermosetting resin composition.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer includes 80% by weight or more but 90% by weight or less of an α-olefin, and 10% by weight or more but 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid. Another particularly preferable ionomer resin is a copolymer formed with ethylene and methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7329", and "Himilan AM7337", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

The resin composition of the cover 6 may include a styrene block-containing thermoplastic elastomer. The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferable. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include an alloy of an olefin and one or more members selected from the group consisting of SBS, SIS, SIBS, SEBS, SEPS, and SEEPS. The olefin component in the alloy is presumed to contribute to improvement of compatibility with another base polymer. The alloy can contribute to the resilience performance of the golf ball 2. An olefin having 2 to 10 carbon atoms is preferable. Examples of suitable olefins include ethylene, propylene, butene, and pentene. Ethylene and propylene are particularly preferable.

Specific examples of polymer alloys include trade names "RABALON T3221C", "RABALON T3339C", "RABALON SJ4400N", "RABALON SJ5400N", "RABALON SJ6400N", "RABALON SJ7400N", "RABALON SJ8400N", "RABALON SJ9400N", and "RABALON SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "SEPTON HG-252" manufactured by Kuraray Co., Ltd.

In light of feel at impact, the proportion of the styrene block-containing thermoplastic elastomer to the entire base polymer is preferably equal to or greater than 2% by weight, more preferably equal to or greater than 4% by weight, and particularly preferably equal to or greater than 6% by weight. In light of spin suppression, the proportion is preferably equal to or less than 30% by weight, more preferably equal to or less than 25% by weight, and particularly preferably equal to or less than 20% by weight.

The resin composition of the cover 6 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

The cover 6 preferably has a nominal thickness T of equal to or less than 1.70 mm. The cover 6 having a nominal thickness T of equal to or less than 1.70 mm does not impair soft feel at impact. In this respect, the nominal thickness T is more preferably equal to or less than 1.65 mm and particularly preferably equal to or less than 1.60 mm. In light of ease of forming the cover 6 and in light of durability of the golf ball 2, the nominal thickness T is preferably equal to or greater than 0.80 mm, more preferably equal to or greater than 0.95 mm, and particularly preferably equal to or greater than 1.05 mm. The nominal thickness T is measured at a position immediately below the land 10 (see FIG. 4).

The product (T*H) of the nominal thickness T and a hardness H of the cover 6 is preferably equal to or less than 150. The cover 6 having a product (T*H) of equal to or less than 150 is flexible and thin. The cover 6 does not impair soft feel at impact. In this respect, the product (T*H) is preferably equal to or less than 145 and particularly preferably equal to or less than 140. In light of spin suppression, the product (T*H) is preferably equal to or greater than 85, more preferably equal to or greater than 90, and particularly preferably equal to or greater than 95.

From the standpoint that the golf ball 2 can have an outer-hard/inner-soft structure as a whole, the hardness H of the cover 6 is preferably equal to or greater than 78, more preferably equal to or greater than 80, and particularly preferably equal to or greater than 82. In light of feel at impact, the hardness H is preferably equal to or less than 93, more preferably equal to or less than 90, and particularly preferably equal to or less than 88.

The hardness H of the cover 6 is measured according to the standards of "ASTM-D 2240-68". The hardness H is measured with a Shore C type hardness scale mounted to an automated hardness meter (trade name "digi test II" manufactured by Heinrich Bareiss Prüfgerätebau GmbH). For the measurement, a sheet that is formed by hot press, is formed from the same material as that of the cover 6, and has a thickness of about 2 mm is used. Prior to the measurement, a sheet is kept at 23° C. for two weeks. At the measurement, three sheets are stacked.

The golf ball 2 preferably meets the following mathematical formula (3).

$$0 \leq H - C1 \leq 20 \quad (3)$$

In other words, the difference (H−C1) between the hardness H of the cover 6 and the surface hardness C1 of the core 4 is preferably equal to or greater than 0 but equal to or less than 20. The golf ball 2 having a difference (H−C1) of equal to or greater than 0 can have an outer-hard/inner-soft structure as a whole. With the golf ball 2, spin can be suppressed. In this respect, the difference (H−C1) is more preferably equal to or greater than 3 and particularly preferably equal to or greater than 5. The golf ball 2 having a difference (H−C1) of equal to or less than 20 has excellent feel at impact. In this respect, the difference (H−C1) is more preferably equal to or less than 18 and particularly preferably equal to or less than 17.

Figure 2:
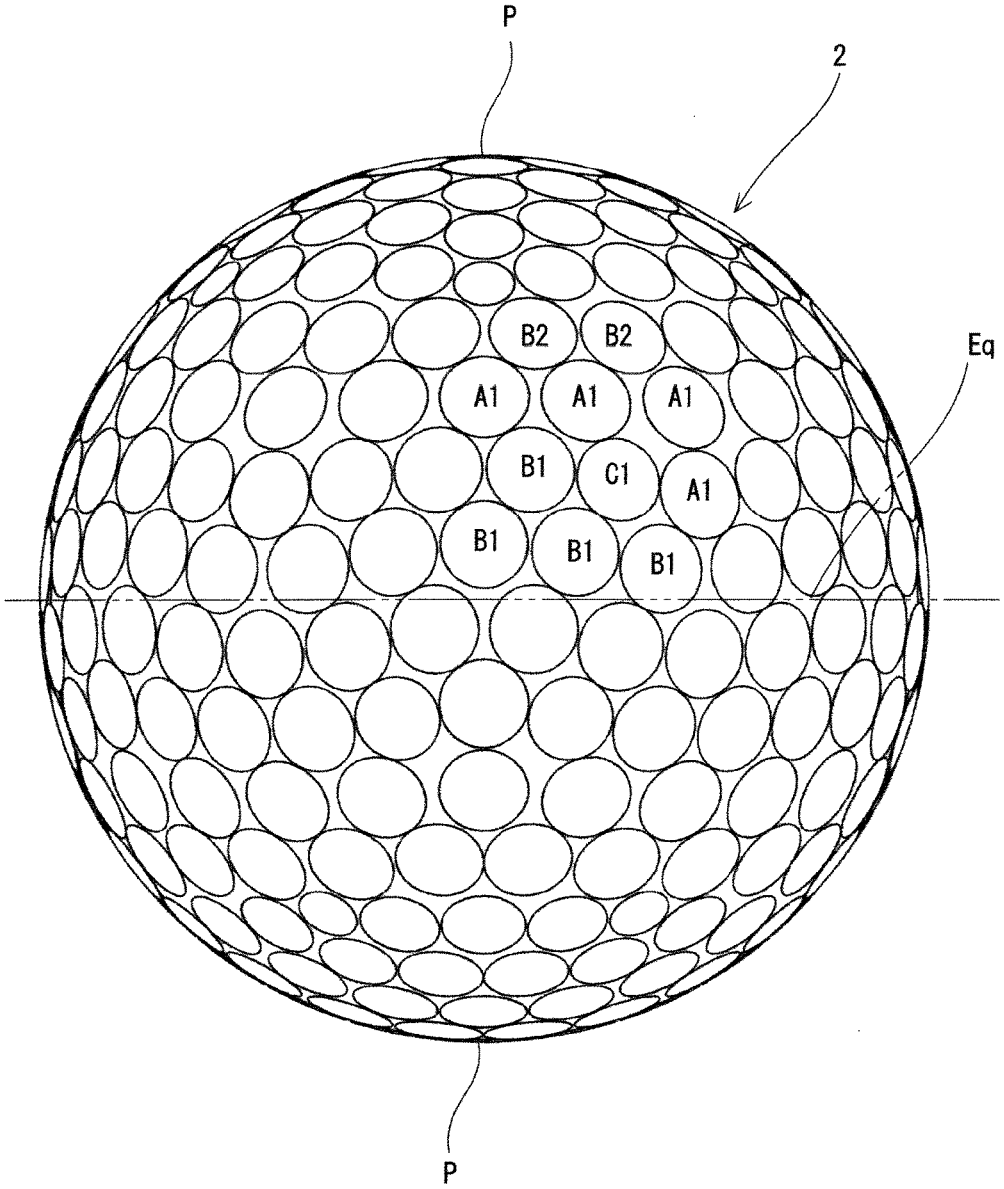
FIG. 2 is an enlarged front view of the golf ball in FIG. 1.

In FIG. 2, a chain double-dashed line Eq indicates an equator, and each reference sign P indicates a pole. Each pole P corresponds to a deepest position of a mold for the golf ball 2. The latitude of the equator Eq is zero. The latitude of each pole is 90°.

Figure 3:
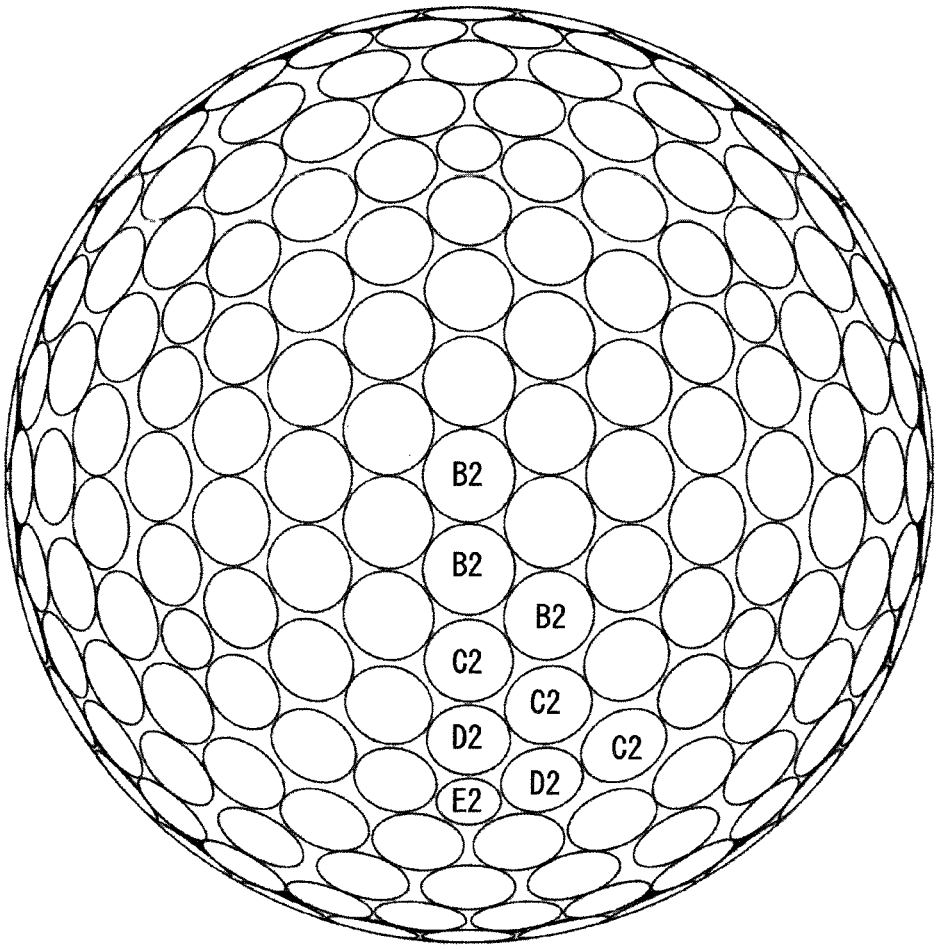
FIG. 3 is a plan view of the golf ball in FIG. 2.

As shown in FIGS. 2 and 3, the contour of each dimple 8 is circular. The golf ball 2 has dimples A1 each having a diameter of 4.40 mm; dimples B1 and B2 each having a diameter of 4.30 mm; dimples C1 and C2 each having a diameter of 4.15 mm; dimples D2 each having a diameter of 3.90 mm; and dimples E2 each having a diameter of 3.00 mm. The depth of each dimple B1 is different from the depth of each dimple B2. The depth of each dimple C1 is different from the depth of each dimple C2. Each of the dimples A1, B1, and C1 has a depth Dp2 of 0.144 mm. Each of the dimples B2, C2, D2, and E2 has a depth Dp2 of 0.126 mm. A method for measuring the depth Dp2 will be described later. The golf ball 2 may have non-circular dimples instead of the circular dimples 8 or together with circular dimples 8.

The number of the dimples A1 is 60; the number of the dimples B1 is 84; the number of the dimples B2 is 74; the number of the dimples C1 is 24; the number of the dimples C2 is 48; the number of the dimples D2 is 36; and the number of the dimples E2 is 12. The total number N of the dimples 8 is 338. A dimple pattern is formed by these dimples 8 and the land 10.

Figure 4:
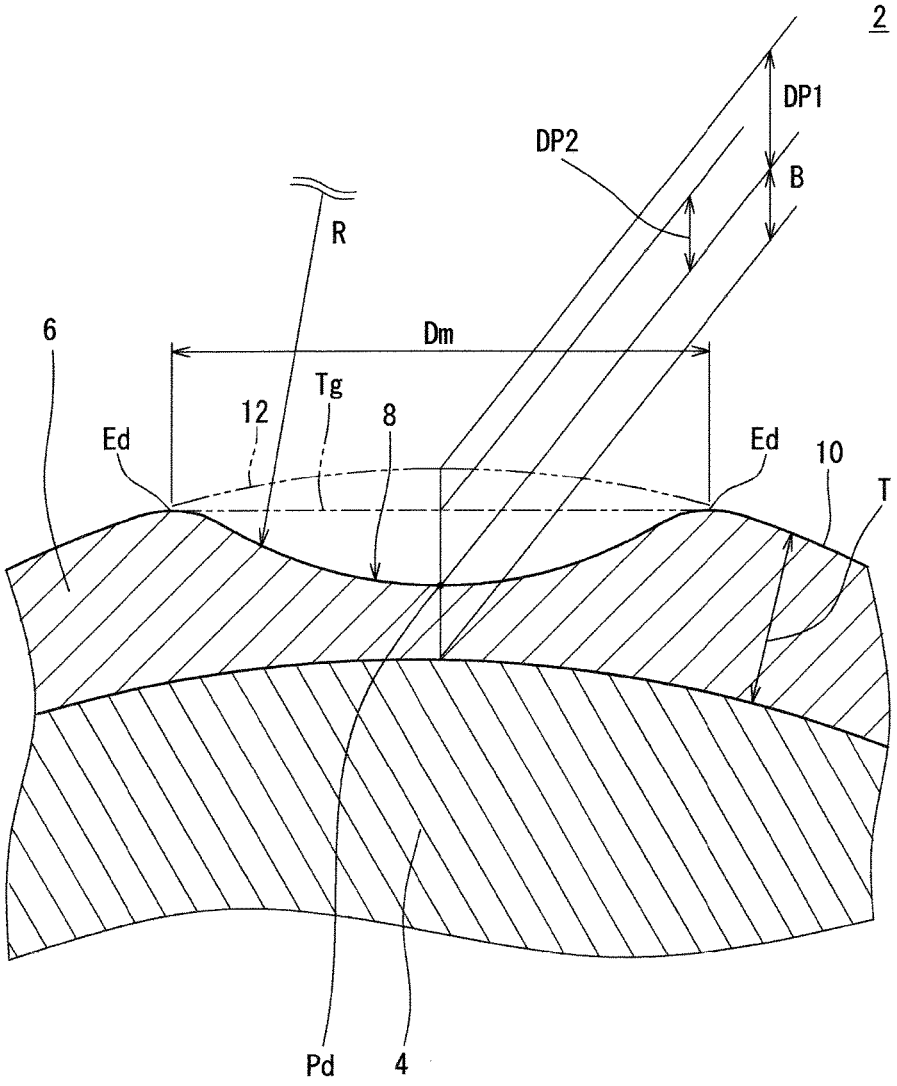
FIG. 4 is a partially enlarged cross-sectional view of the golf ball in FIG. 1.

FIG. 4 shows a cross section of the golf ball 2 along a plane passing through the central point of the dimple 8 and the central point of the golf ball 2. In FIG. 4, the top-to-bottom direction is the depth direction of the dimple 8. In FIG. 4, a chain double-dashed line 12 indicates a phantom sphere. The surface of the phantom sphere 12 is the surface of the golf ball 2 when it is postulated that no dimple 8 exists. The diameter of the phantom sphere 12 is equal to the diameter of the golf ball 2. The dimple 8 is recessed from the surface of the phantom sphere 12. The land 10 coincides with the surface of the phantom sphere 12. In the present embodiment, the cross-sectional shape of each dimple 8 is substantially a circular arc. The cross-sectional shape may be a curved Line of which the curvature changes.

In FIG. 4, an arrow Dm indicates the diameter of the dimple 8. The diameter Dm is the distance between two tangent points Ed appearing on a tangent line Tg that is drawn tangent to the far opposite ends of the dimple 8. Each tangent point Ed is also the edge of the dimple 8. The edge Ed defines the contour of the dimple 8. In FIG. 4, an arrow Dp1 indicates a first depth of the dimple 8. The first depth Dp1 is the distance between the deepest point Pd of the dimple 8 and the surface of the phantom sphere 12. In FIG. 4, an arrow Dp2 indicates a second depth of the dimple 8. The second depth Dp2 is the distance between the deepest point Pd of the dimple 8 and the tangent line Tg. In FIG. 4, an arrow T indicates the nominal thickness of the cover 6.

As is obvious from FIG. 4, the thickness of the cover 6 immediately below the dimple 8 is smaller than the nominal thickness T. Particularly, the thickness of the cover 6 immediately below the deepest point Pd is very small. In FIG. 4, an arrow B indicates the thickness of the cover 6 immediately below the deepest point Pd of the dimple 8. Each of the thicknesses B of all the dimples 8 is preferably equal to or greater than 0.85 mm.

The diameter Dm of each dimple 8 is preferably equal to or greater than 2.0 mm but equal to or less than 6.0 mm. The dimple 8 having a diameter Dm of equal to or greater than 2.0 mm disturbs air flow around the golf ball 2 when the golf ball 2 flies. This phenomenon is referred to as turbulization. Because of the turbulization, a large flight distance of the golf ball 2 is achieved. In this respect, the diameter Dm is more preferably equal to or greater than 2.5 mm and particularly preferably equal to or greater than 2.8 mm. The dimple 8 having a diameter Dm of equal to or less than 6.0 mm does not impair a fundamental feature of the golf ball 2 being substantially a sphere. In this respect, the diameter Dm is more preferably equal to or less than 5.5 mm and particularly preferably equal to or less than 5.0 mm.

The area S of the dimple 8 is the area of a region surrounded by the contour line of the dimple 8 when the central point of the golf ball 2 is viewed at infinity. In the case of a circular dimple 8, the area S is calculated by the following mathematical formula.

$$S = (Dm/2)^2 * \pi$$

In the golf ball 2 shown in FIGS. 2 and 3, the area of each dimple A1 is 15.2 $mm^2$; the area S of each of the dimples B1 and B2 is 14.5 $mm^2$; the area S of each of the dimples C1 and C2 is 13.5 $mm^2$; the area S of each dimple D2 is 11.9 $mm^2$; and the area S of each dimple E2 is 7.1 $mm^2$.

In the present invention, the ratio of the sum of the areas S of all the dimples 8 relative to the surface area of the phantom sphere 12 is referred to as an occupation ratio So. In the golf ball 2 shown in FIGS. 2 and 3, the total area of the dimples 8 is 4695.4 $mm^2$. The surface area of the phantom sphere 12 of the golf ball 2 is 5728.0 $mm^2$, so that the occupation ratio So is 0.82.

As described above, the thickness of the cover 6 immediately below each dimple 8 is small. When the golf ball 2 is hit with a golf club, a crack easily occurs in the cover 6 immediately below the dimples 8. When hitting is repeated, the crack grows to break the golf ball 2. In light of suppression of a crack, the occupation ratio So is preferably low. The occupation ratio So is preferably equal to or less than 0.88, more preferably equal to or less than 0.86, and particularly preferably equal to or less than 0.84. In light of promotion of turbulization, the occupation ratio So is preferably equal to or greater than 0.76, more preferably equal to or greater than 0.78, and particularly preferably equal to or greater than 0.80.

As described above, the thickness B of the cover 6 immediately below the deepest point Pd of each dimple 8 is very small. When the golf ball 2 is hit with a golf club, a crack easily occurs in the cover 6 immediately below the deepest point Pd. When hitting is repeated, the crack grows to break the golf ball 2. In light of suppression of a crack, the number of the deepest points Pd is preferably small. In other words, the total number N of the dimples 8 is preferably small. The total number N is preferably equal to or less than 420, more preferably equal to or less than 400, and particularly preferably equal to or less than 380. In light of promotion of turbulization, the total number N is preferably equal to or greater than 260, more preferably equal to or greater than 290, and particularly preferably equal to or greater than 300.

In light of suppression of a crack, the thickness B at each dimple 8 is preferably equal to or greater than 0.3 mm, more preferably equal to or greater than 0.5 mm, and particularly preferably equal to or greater than 0.7 mm. The average value Bb of the thicknesses B at all the dimples 8 is preferably equal to or greater than 0.5 mm, more preferably equal to or greater than 0.7 mm, and particularly preferably equal to or greater than 0.85 mm. The thickness B is preferably equal to or less than 2.5 mm and particularly preferably equal to or less than 2.3 mm.

A value V calculated by the following mathematical formula is preferably equal to or less than 290.

$$V=N*So/Bb$$

When the golf ball 2 having a value V of equal to or less than 290 is hit with a golf club, a crack is less likely to occur. Although the amount of compressive deformation Df of the core 4 is large and the nominal thickness T of the cover 6 is small, the golf ball 2 has excellent durability. In light of durability, the value V is more preferably equal to or less than 283 and particularly preferably equal to or less than 254. In light of flight performance and feel at impact, the value V is preferably equal to or greater than 170 and particularly preferably equal to or greater than 198.

In light of suppression of rising of the golf ball 2 during flight, the first depth Dp1 of each dimple 8 is preferably equal to or greater than 0.10 mm, more preferably equal to or greater than 0.13 mm, and particularly preferably equal to or greater than 0.15 mm. In light of suppression of a crack and in light of suppression of dropping of the golf ball 2 during flight, the first depth Dp1 is preferably equal to or less than 0.65 mm, more preferably equal to or less than 0.60 mm, and particularly preferably equal to or less than 0.55 mm.

In the present invention, the "volume of the dimple" means the volume of a portion surrounded by the surface of the dimple 8 and the plane including the contour of the dimple 8. The total volume of the dimples 8 is preferably equal to or greater than 280 $mm^3$ but equal to or less than 340 $mm^3$. With the golf ball 2 in which the total volume is equal to or greater than 280 $mm^3$, rising during flight is suppressed. In this respect, the total volume is more preferably equal to or greater than 285 $mm^3$ and particularly preferably equal to or greater than 290 $mm^3$. With the golf ball 2 in which the total volume is equal to or less than 340 $mm^3$, a sufficient lift force occurs although the amount of compressive deformation Df is small.

In this respect, the total volume is more preferably equal to or less than 335 $mm^3$ and particularly preferably equal to or less than 330 $mm^3$.

Figure 5:
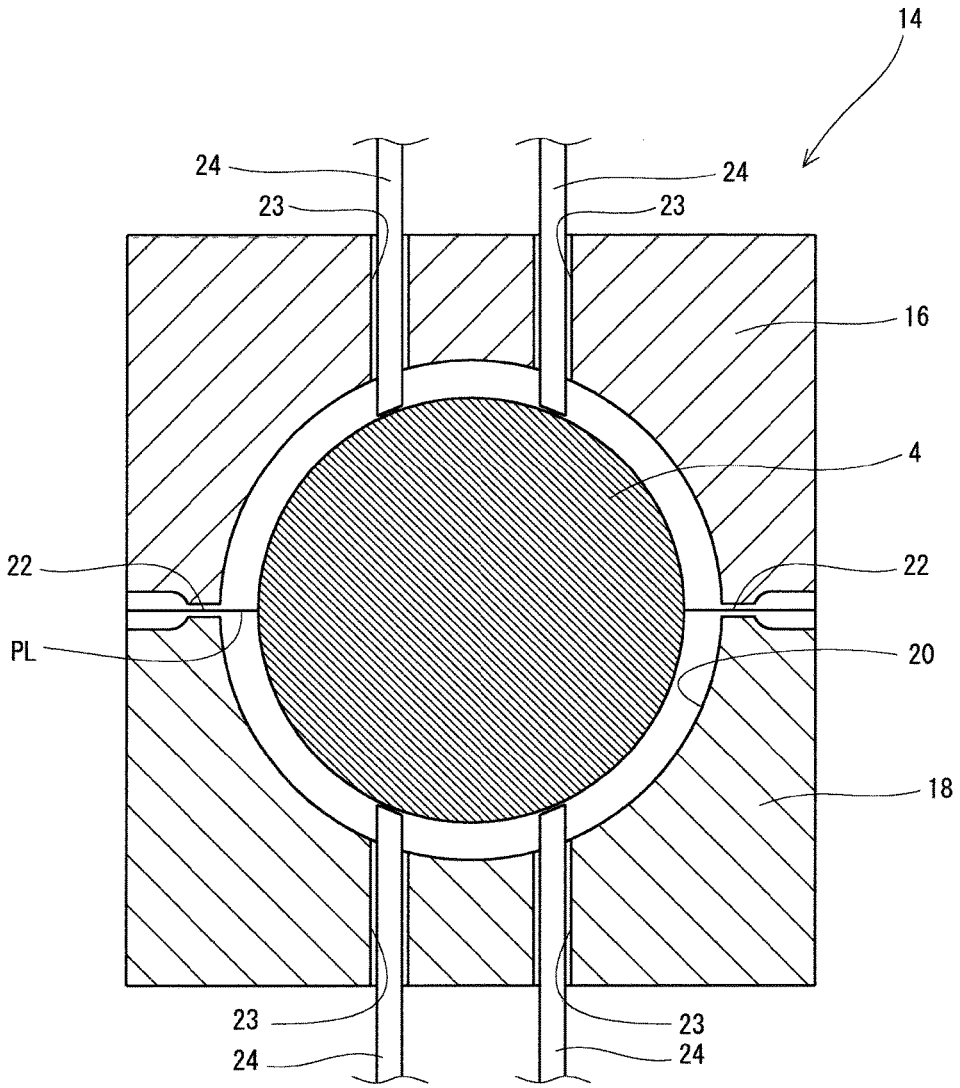
FIG. 5 is a cross-sectional view showing a mold for the golf ball in FIG. 1 together with a core of the golf ball.

FIG. 5 shows a mold 14 for the golf ball 2 in FIG. 1. FIG. 5 also shows the core 4. The mold 14 includes an upper mold half 16 and a lower mold half 18. By mating the upper mold half 16 and the lower mold half 18 with each other, a cavity is formed. Although not shown in the drawing, a plurality of pimples are present on a cavity face 20 of the mold 14. The number of the pimples is equal to the number of the dimples 8.

A parting line PL between the upper mold half 16 and the lower mold half 18 corresponds to the equator Eq of the golf ball 2. The parting line PL may be slightly displaced from the equator Eq. The parting line PL may be a zigzag line. A plurality of gates 22 are present on the parting line PL. The gates 22 are aligned along the equator of the cavity. The gates 22 may be slightly displaced from the equator. The latitude of an opening of each gate 22 which opening is formed in the cavity face 20 is preferably equal to or greater than 0° but equal to or less than 20°. The latitude is zero in the mold 14 shown in FIG. 5.

The upper mold half 16 has a plurality of pin holes 23 and a plurality of pins 24. Each pin 24 is inserted through the pin hole 23. The number of the pins 24 of the upper mold half 16 is normally equal to or greater than 3 but equal to or less than 8. The lower mold half 18 has a plurality of pin holes 23 and a plurality of pins 24. Each pin 24 is inserted through the pin hole 23. The number of the pins 24 of the lower mold half 18 is normally equal to or greater than 3 but equal to or less than 8. Each pin 24 is movable in the up-down direction in FIG. 5. The latitude of an opening of each pin hole 23 which opening is formed in the cavity face 20 is normally equal to or greater than 60° but equal to or less than 80°.

The core 4 is placed into the mold 14, and the upper mold half 16 and the lower mold half 18 are mated with each other. The pins 24 move toward the core 4, and the leading ends of the pins 24 come into contact with the core 4. The core 4 is held at the center of the cavity by these pins 24. A melted resin composition is injected from the gates 22 toward the space between the cavity face 20 and the core 4. The resin composition moves toward each pole of the cavity. Immediately before the injection of the resin composition is completed, the pins 24 retract. The pins 24 retract to positions at which the leading ends thereof substantially coincide with the cavity face 20. Spaces occurring due to the retraction of the pins 24 are also filled with the resin composition. The resin composition solidifies to form the cover 6. On the cover 6, the dimples 8 having a shape that is the inverted shape of the pimples are formed.

In light of uniformly filling with the melted resin composition, the number of the gates 22 is preferably equal to or greater than 12. This number is preferably equal to or less than 24.

The temperature of the resin composition decreases until the resin composition reaches each pole from the gates 22. The temperature of the resin composition with which the spaces occurring due to the retraction of the pins 24 is filled is low. In a portion of the cover 6 near each pin 24, crystallization of the resin is insufficient. In this portion, a crack easily occurs.

Immediately below the dimples 8 near each pole P, the following two bad conditions arise:

(1) the thickness of the cover 6 is small; and (2) crystallization of the resin is insufficient.

In a conventional golf ball 2, each dimple 8 near each pole P easily becomes a starting point of a crack.

In the golf ball 2 according to the present invention, the average Bp of the thicknesses B of the cover 6 at all the dimples 8 that are present in the zone in which the latitude is equal to or greater than 30° is larger than the average Bs of the thicknesses B of the cover 6 at all the dimples 8 that are present in the zone in which the latitude is less than 30°. With the large average Bp, a crack is suppressed. The golf ball 2 has excellent durability. In light of durability, the average Bp is preferably equal to or greater than 0.70 mm, more preferably equal to or greater than 0.80 mm, and particularly preferably equal to or greater than 1.00 mm. The difference (Bp−Bs) is preferably equal to or greater than 0.010 mm and particularly preferably equal to or greater than 0.015 mm. The difference (Bp−Bs) is preferably equal to or less than 0.05 mm.

EXAMPLES

Example 1

A rubber composition b was obtained by kneading 100 parts by weight of a high-cis polybutadiene (trade name "BR-730", manufactured by JSR Corporation), 22.2 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. This rubber composition b was placed into a mold including upper and lower mold halves each having a hemispherical cavity, and heated at 160° C. for 20 minutes to obtain a core with a diameter of 39.8 mm.

A resin composition B was obtained by kneading 47 parts by weight of an ionomer resin (the aforementioned "Himilan 1555"), 46 parts by weight of another ionomer resin (the aforementioned "Himilan 1557"), 7 parts by weight of a styrene block-containing thermoplastic elastomer (the aforementioned "RABALON T3221C"), 4 parts by weight of titanium dioxide, and 0.2 parts by weight of a light stabilizer (trade name "JF-90", manufactured by Johoku Chemical Co., Ltd.) with a twin-screw kneading extruder. The core was placed into the mold shown in FIG. 5. The melted resin composition B was injected from gates to cover the core to form a cover with a thickness of 1.45 mm. Dimples having a shape that is the inverted shape of the pimples were formed on the cover.

A clear paint including a two-component curing type polyurethane as a base material was applied to this cover to obtain a golf ball of Example 1 with a diameter of about 42.7 mm and a weight of about 45.6 g. Dimple specifications I of the golf ball are shown in detail in Table 3 below.

Examples 2 to 9 and Comparative Examples 1 to 6

Golf balls of Examples 2 to 9 and Comparative Examples 1 to 6 were obtained in the same manner as Example 1, except the specifications of the core, the cover, and the dimples were as shown in Tables 6 to 8 below. The specifications of the core are shown in detail in Table 1 below. The specifications of the cover are shown in detail in Table 2 below. The specifications of the dimples are shown in detail in Tables 3 to 5 below. Each of the crosslinking time periods for the core in Examples 2 to 9 and Comparative Examples 1 to 6 is 20 minutes. Each of the crosslinking temperature for the core in Examples 2 to 6, 8, and 9 and Comparative Examples 1 to 6 is 160° C. The crosslinking temperature for the core in Example 7 is 140° C.

[Flight Test]

A driver (trade name "XXIO8", manufactured by DUNLOP SPORTS CO. LTD., shaft hardness: R, loft angle: 10.5°) was attached to a swing machine manufactured by Golf Laboratories, Inc. A golf ball was hit under a condition of a head speed of 40 m/sec, and the ball initial speed, the spin rate, and the flight distance were measured. The flight distance is the distance between the point at the hit and the point at which the golf ball stopped. The average value of values obtained by 12 measurements is shown in Tables 6 to 8 below.

[Durability]

A golf ball was caused to collide against a metallic plate, and the number of times of the collision required to break the golf ball was counted. The average of values obtained by 12 measurements is shown as an index in Tables 6 to 8 below.

[Feel at Impact]

Thirty golf players hit golf balls with drivers and were asked about feeling. The evaluation was categorized as follows on the basis of the number of golf players who answered, "the feeling was favorable".

A: 25 or more

B: 20 to 24

C: 15 to 19

D: 14 or less

The results are shown in Tables 6 to 8 below.

TABLE 1

| Composition of Core (parts by weight) | | | | |
|---|---|---|---|---|
| | a | b | c | d |
| Polybutadiene | 100 | 100 | 100 | 100 |
| Zinc diacrylate | 21.4 | 22.2 | 24.6 | 25.4 |
| Zinc oxide | 5 | 5 | 5 | 5 |
| Barium sulfate | A.A. | A.A. | A.A. | A.A |
| Diphenyl disulfide | 0.5 | 0.5 | 0.5 | 0.5 |
| Dicumyl peroxide | 0.9 | 0.9 | 0.9 | 0.9 |

A.A.: Appropriate amount

TABLE 2

| Composition of Cover (parts by weight) | | | | |
|---|---|---|---|---|
| | A | B | C | D |
| Himilan AM7337 | 43 | — | — | — |
| Himilan AM7329 | 40 | — | 40 | 63 |
| Himilan 1555 | — | 47 | — | 35 |

TABLE 2-continued

| Composition of Cover (parts by weight) | A | B | C | D |
|---|---|---|---|---|
| Himilan 1557 | — | 46 | — | — |
| Himilan 1605 | — | — | 54 | — |
| RABALON T3221C | 17 | 7 | 6 | 2 |
| Titanium dioxide (A220) | 6 | 4 | 3 | 3 |
| JF-90 | 0.2 | 0.2 | 0.2 | 0.2 |
| Hardness (Shore C) | 83 | 86 | 90 | 93 |

TABLE 3

Specifications of Dimples

| Type | | Number | Dm (mm) | Dp2 (mm) | Dp1 (mm) | R (mm) | Volume ($mm^3$) | Total volume ($mm^3$) |
|---|---|---|---|---|---|---|---|---|
| I | A1 | 60 | 4.40 | 0.144 | 0.258 | 16.9 | 1.10 | 318 |
| | B1 | 84 | 4.30 | 0.144 | 0.253 | 16.1 | 1.05 | |
| | B2 | 74 | 4.30 | 0.126 | 0.235 | 18.4 | 0.92 | |
| | C1 | 24 | 4.15 | 0.144 | 0.245 | 15.0 | 0.98 | |
| | C2 | 48 | 4.15 | 0.126 | 0.227 | 17.1 | 0.85 | |
| | D2 | 36 | 3.90 | 0.126 | 0.215 | 15.2 | 0.75 | |
| | E2 | 12 | 3.00 | 0.126 | 0.179 | 9.0 | 0.45 | |
| II | A1 | 60 | 4.25 | 0.146 | 0.252 | 15.5 | 1.04 | 301 |
| | B1 | 84 | 4.15 | 0.146 | 0.247 | 14.8 | 0.99 | |
| | B2 | 74 | 4.15 | 0.128 | 0.229 | 16.9 | 0.87 | |
| | C1 | 24 | 4.00 | 0.146 | 0.240 | 13.8 | 0.92 | |
| | C2 | 48 | 4.00 | 0.128 | 0.222 | 15.7 | 0.81 | |
| | D2 | 36 | 3.75 | 0.128 | 0.210 | 13.8 | 0.71 | |
| | E2 | 12 | 2.85 | 0.128 | 0.176 | 8.0 | 0.41 | |
| III-1 | A1 | 8 | 4.57 | 0.140 | 0.263 | 18.7 | 1.15 | 312 |
| | A2 | 22 | 4.57 | 0.122 | 0.245 | 21.5 | 1.00 | |
| | B1 | 18 | 4.47 | 0.140 | 0.257 | 17.9 | 1.10 | |
| | B2 | 48 | 4.47 | 0.122 | 0.239 | 20.5 | 0.96 | |
| | C1 | 60 | 4.37 | 0.140 | 0.252 | 17.1 | 1.05 | |
| | C2 | 34 | 4.37 | 0.122 | 0.234 | 19.6 | 0.92 | |
| | D1 | 44 | 4.27 | 0.140 | 0.247 | 16.3 | 1.00 | |
| | D2 | 30 | 4.27 | 0.122 | 0.229 | 18.7 | 0.87 | |
| | E1 | 28 | 4.13 | 0.140 | 0.240 | 15.3 | 0.94 | |
| | E2 | 10 | 4.13 | 0.122 | 0.222 | 17.5 | 0.82 | |
| | F1 | 14 | 3.80 | 0.140 | 0.225 | 13.0 | 0.80 | |
| | G2 | 8 | 3.58 | 0.122 | 0.197 | 13.2 | 0.61 | |

TABLE 4

Specifications of Dimples

| Type | | Number | Dm (mm) | Dp2 (mm) | Dp1 (mm) | R (mm) | Volume ($mm^3$) | total volume ($mm^3$) |
|---|---|---|---|---|---|---|---|---|
| III-2 | A1 | 8 | 4.57 | 0.131 | 0.254 | 20.0 | 1.08 | 311 |
| | A2 | 22 | 4.57 | 0.131 | 0.254 | 20.0 | 1.08 | |
| | B1 | 18 | 4.47 | 0.131 | 0.248 | 19.1 | 1.03 | |
| | B2 | 48 | 4.47 | 0.131 | 0.248 | 19.1 | 1.03 | |
| | C1 | 60 | 4.37 | 0.131 | 0.243 | 18.3 | 0.98 | |
| | C2 | 34 | 4.37 | 0.131 | 0.243 | 18.3 | 0.98 | |
| | D1 | 44 | 4.27 | 0.131 | 0.238 | 17.5 | 0.94 | |
| | D2 | 30 | 4.27 | 0.131 | 0.238 | 17.5 | 0.94 | |
| | E1 | 28 | 4.13 | 0.131 | 0.231 | 16.3 | 0.88 | |
| | E2 | 10 | 4.13 | 0.131 | 0.231 | 16.3 | 0.88 | |
| | F1 | 14 | 3.80 | 0.131 | 0.216 | 13.8 | 0.74 | |
| | G2 | 8 | 3.58 | 0.131 | 0.206 | 12.3 | 0.66 | |
| IV | A1 | 72 | 4.91 | 0.158 | 0.300 | 19.2 | 1.50 | 328 |
| | A2 | 84 | 4.91 | 0.122 | 0.264 | 24.8 | 1.16 | |
| | B1 | 54 | 4.65 | 0.158 | 0.285 | 17.2 | 1.34 | |
| | B2 | 44 | 4.65 | 0.122 | 0.249 | 22.2 | 1.04 | |
| | C2 | 12 | 3.00 | 0.122 | 0.175 | 9.3 | 0.43 | |
| V | A1 | 144 | 4.00 | 0.145 | 0.239 | 13.9 | 0.91 | 306 |
| | A2 | 126 | 4.00 | 0.125 | 0.219 | 16.1 | 0.79 | |
| | B1 | 42 | 3.75 | 0.145 | 0.227 | 12.2 | 0.80 | |
| | B2 | 60 | 3.75 | 0.125 | 0.207 | 14.1 | 0.69 | |

TABLE 5

Specifications of Dimples

| Type | | Number | Dm (mm) | Dp2 (mm) | Dp1 (mm) | R (mm) | Volume ($mm^3$) | total volume ($mm^3$) |
|---|---|---|---|---|---|---|---|---|
| VI | A2 | 70 | 4.10 | 0.140 | 0.239 | 15.1 | 0.93 | 339 |
| | B1 | 30 | 3.95 | 0.140 | 0.232 | 14.0 | 0.86 | |
| | C1 | 20 | 3.85 | 0.140 | 0.227 | 13.3 | 0.82 | |
| | C2 | 100 | 3.85 | 0.140 | 0.227 | 13.3 | 0.82 | |
| | D1 | 130 | 3.75 | 0.140 | 0.222 | 12.6 | 0.77 | |
| | D2 | 40 | 3.75 | 0.140 | 0.222 | 12.6 | 0.77 | |
| | E1 | 20 | 3.65 | 0.140 | 0.218 | 12.0 | 0.73 | |
| | F1 | 12 | 2.50 | 0.140 | 0.177 | 5.7 | 0.35 | |
| VII | A1 | 126 | 3.70 | 0.155 | 0.235 | 11.1 | 0.84 | 306 |
| | A2 | 114 | 3.70 | 0.135 | 0.215 | 12.7 | 0.73 | |
| | B1 | 54 | 3.60 | 0.155 | 0.231 | 10.5 | 0.79 | |
| | B2 | 66 | 3.60 | 0.135 | 0.211 | 12.1 | 0.69 | |
| | C1 | 42 | 2.50 | 0.155 | 0.192 | 5.1 | 0.38 | |
| | C2 | 42 | 2.50 | 0.135 | 0.172 | 5.9 | 0.33 | |

TABLE 6

Results of Evaluation

Figure 6:
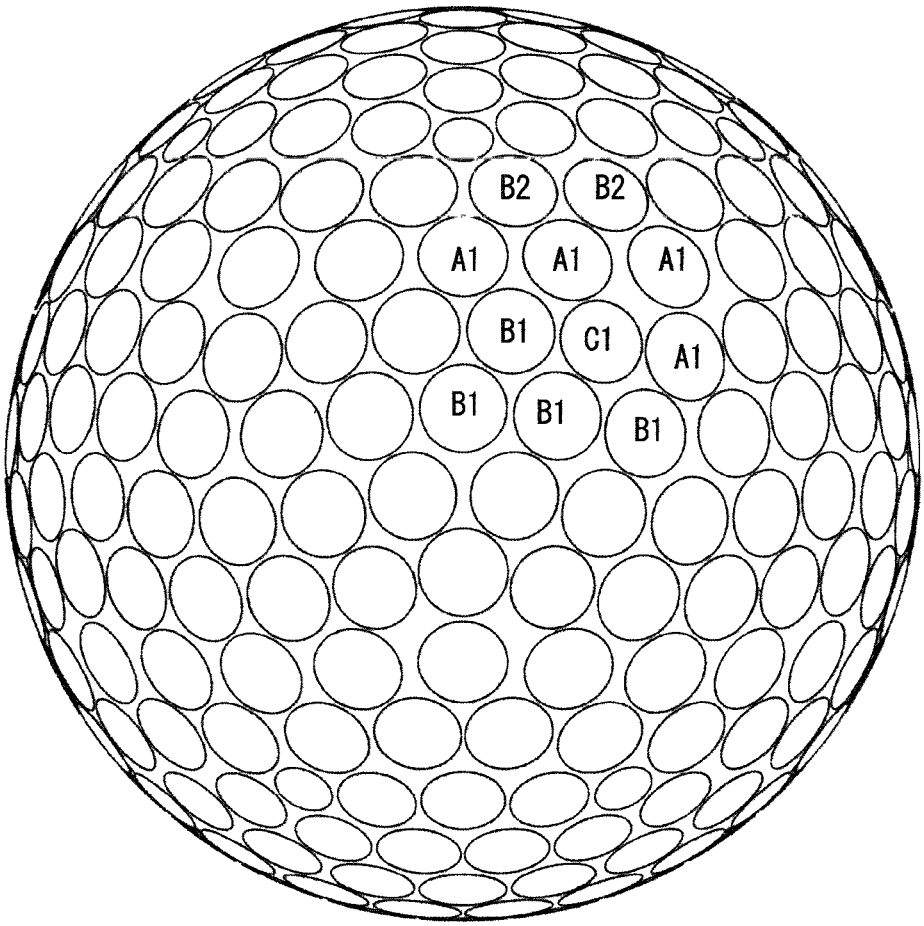
FIG. 6 is a front view of a golf ball according to Example 4 of the present invention.
Figure 7:
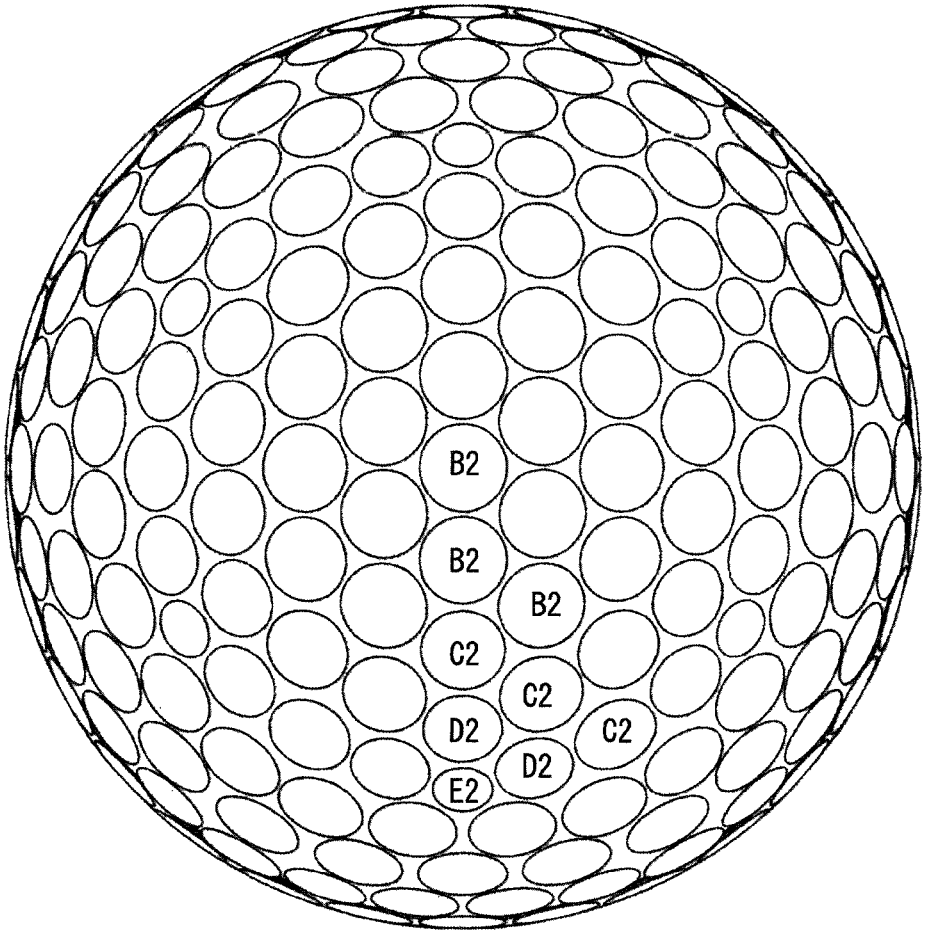
FIG. 7 is a plan view of the golf ball in FIG. 6.
Figure 10:
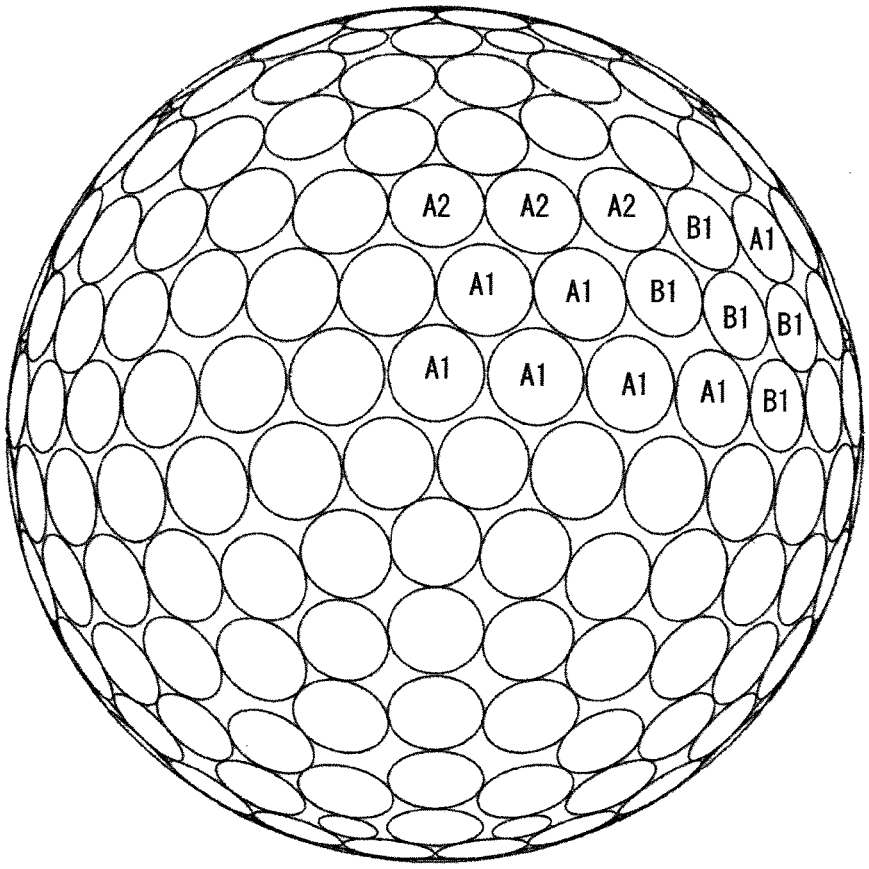
FIG. 10 is a front view of a golf ball according to Example 3 of the present invention.
Figure 11:
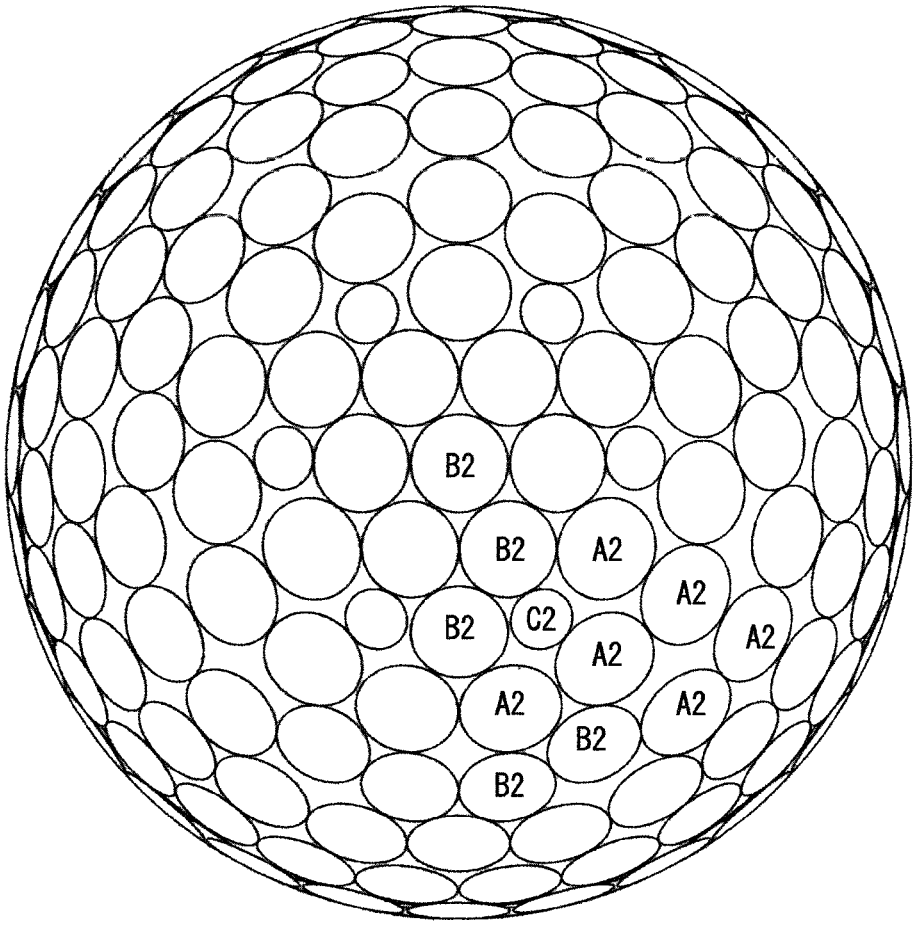
FIG. 11 is a plan view of the golf ball in FIG. 10.

| | Ex. 1 | Ex. 2 | Ex. 3 | Ex. 4 | Ex. 5 |
|---|---|---|---|---|---|
| Core | | | | | |
| Composition | b | b | b | b | c |
| C.T. (° C.) | 160 | 160 | 160 | 160 | 160 |
| Diam. (mm) | 39.8 | 39.4 | 40.6 | 40.2 | 39.8 |
| Df (mm) | 4.8 | 4.8 | 4.8 | 4.8 | 4.2 |
| C0 (Shore C) | 58 | 58 | 58 | 58 | 64 |
| C1 (Shore C) | 72 | 71 | 73 | 73 | 76 |
| Cover | | | | | |
| Composition | B | D | C | A | B |
| T (mm) | 1.45 | 1.65 | 1.05 | 1.25 | 1.45 |
| H (Shore C) | 86 | 93 | 90 | 83 | 86 |
| T * H | 125 | 153 | 95 | 104 | 125 |
| H − C1 | 14 | 22 | 17 | 10 | 10 |
| C1 − C0 | 14 | 13 | 15 | 15 | 12 |
| Dimple | | | | | |
| Type | I | I | IV | II | I |
| Front view | FIG. 2 | FIG. 2 | FIG. 10 | FIG. 6 | FIG. 2 |
| Plan view | FIG. 3 | FIG. 3 | FIG. 11 | FIG. 7 | FIG. 3 |
| Number N | 338 | 338 | 266 | 338 | 338 |
| So | 0.82 | 0.82 | 0.82 | 0.76 | 0.82 |
| Bb (mm) | 1.20 | 1.40 | 0.77 | 1.01 | 1.20 |
| V | 231 | 198 | 283 | 254 | 231 |
| Bs | 1.19 | 1.39 | 0.75 | 0.99 | 1.19 |
| Bp | 1.22 | 1.42 | 0.79 | 1.02 | 1.22 |
| Speed (m/s) | 57.0 | 57.2 | 56.9 | 56.9 | 57.3 |
| Spin (rpm) | 2500 | 2440 | 2620 | 2600 | 2640 |
| Distance (m) | 198.0 | 199.6 | 196.1 | 195.5 | 198.1 |
| Durability | 100 | 110 | 90 | 95 | 105 |
| Feel at impact | B | C | A | A | C |

C.T.: Crosslinking temperature

TABLE 7

Figure 8:
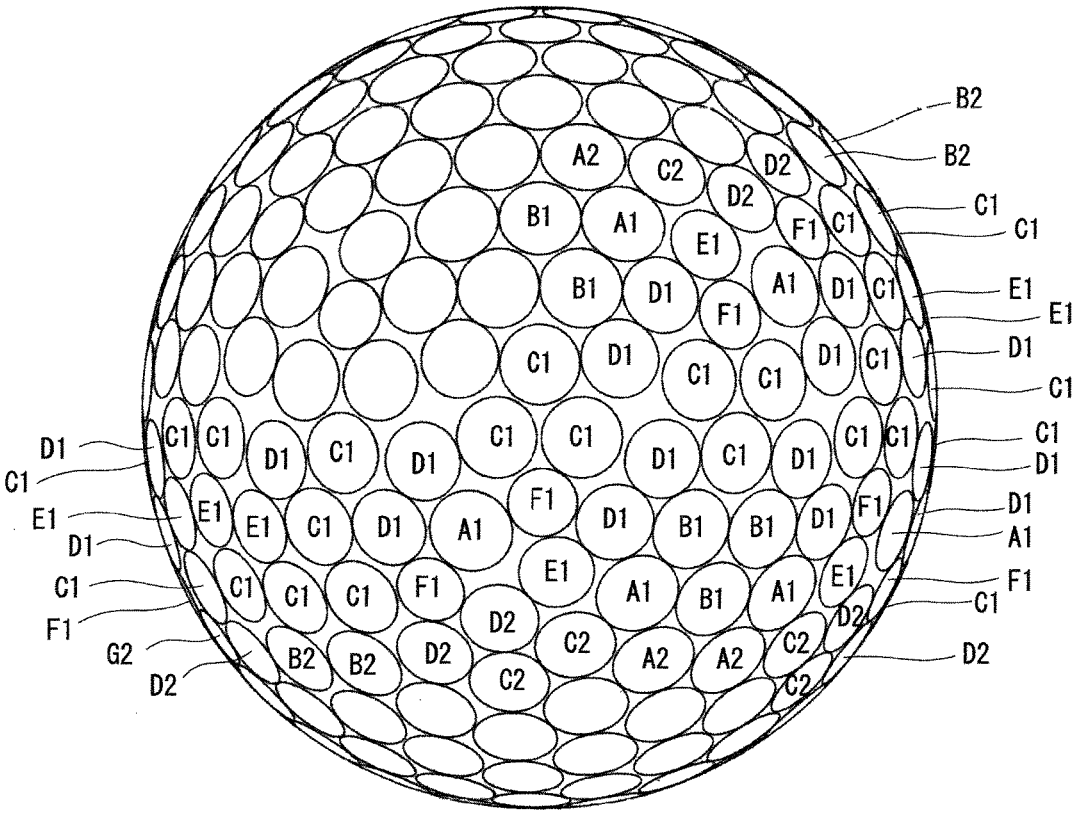
FIG. 8 is a front view of a golf ball according to Example 9 of the present invention.
Figure 9:
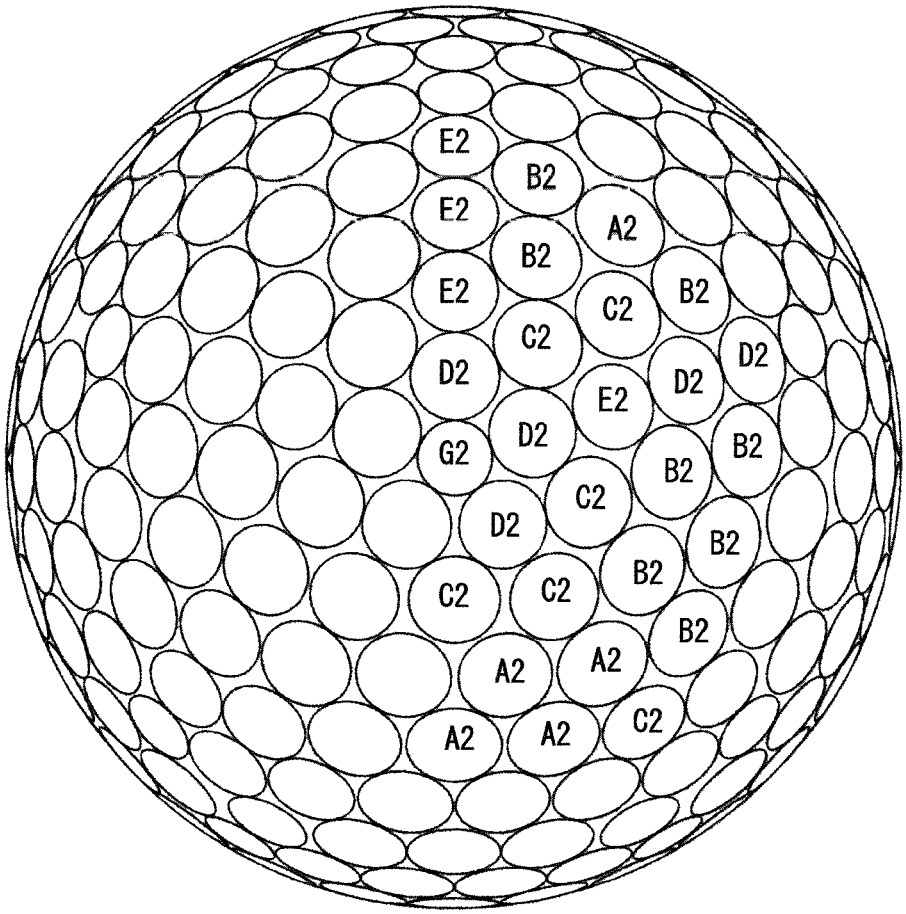
FIG. 9 is a plan view of the golf ball in FIG. 8.

| Results of Evaluation | | | | | |
|---|---|---|---|---|---|
| | Ex. 6 | Ex. 7 | Ex. 8 | Ex. 9 | Comp. EX 1 |
| Core | | | | | |
| Composition | a | c | b | b | c |
| C.T. (° C.) | 160 | 140 | 160 | 160 | 160 |
| Diam. (mm) | 39.8 | 39.8 | 39.8 | 39.8 | 39.0 |
| Df (mm) | 5.0 | 4.4 | 4.8 | 4.8 | 4.2 |
| C0 (Shore C) | 54 | 62 | 58 | 58 | 64 |
| C1 (Shore C) | 67 | 69 | 72 | 72 | 75 |
| Cover | | | | | |
| Composition | B | B | B | B | C |
| T (mm) | 1.45 | 1.45 | 1.45 | 1.45 | 1.85 |
| H (Shore C) | 86 | 86 | 86 | 86 | 90 |
| T * H | 125 | 125 | 125 | 125 | 167 |
| H − C1 | 19 | 17 | 14 | 14 | 15 |
| C1 − C0 | 13 | 7 | 14 | 14 | 11 |
| Dimple | | | | | |
| Type | I | I | III-1 | III-2 | III-2 |
| Front view | FIG. 2 | FIG. 2 | FIG. 8 | FIG. 8 | FIG. 8 |
| Plan view | FIG. 3 | FIG. 3 | FIG. 9 | FIG. 9 | FIG. 9 |
| Number N | 338 | 338 | 324 | 324 | 324 |
| So | 0.82 | 0.82 | 0.83 | 0.83 | 0.83 |
| Bb (mm) | 1.20 | 1.20 | 1.20 | 1.20 | 1.60 |
| V | 231 | 231 | 224 | 224 | 224 |
| Bs | 1.19 | 1.19 | 1.19 | 1.20 | 1.60 |
| Bp | 1.22 | 1.22 | 1.21 | 1.20 | 1.60 |
| Speed (m/s) | 56.8 | 57.2 | 57.0 | 57.0 | 57.2 |
| Spin (rpm) | 2480 | 2740 | 2500 | 2500 | 2530 |
| Distance (m) | 197.2 | 196.6 | 197.6 | 197.4 | 198.3 |
| Durability | 95 | 105 | 105 | 95 | 95 |
| Feel at impact | A | C | B | B | D |

TABLE 8

Figure 12:
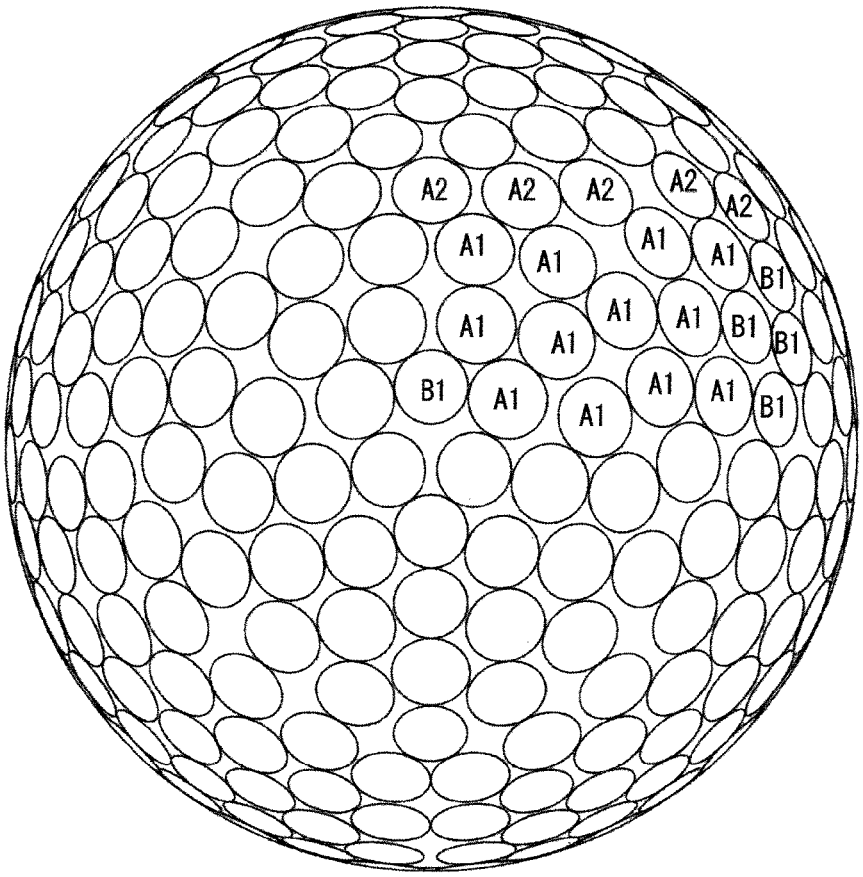
FIG. 12 is a front view of a golf ball according to Comparative Example 4.
Figure 13:
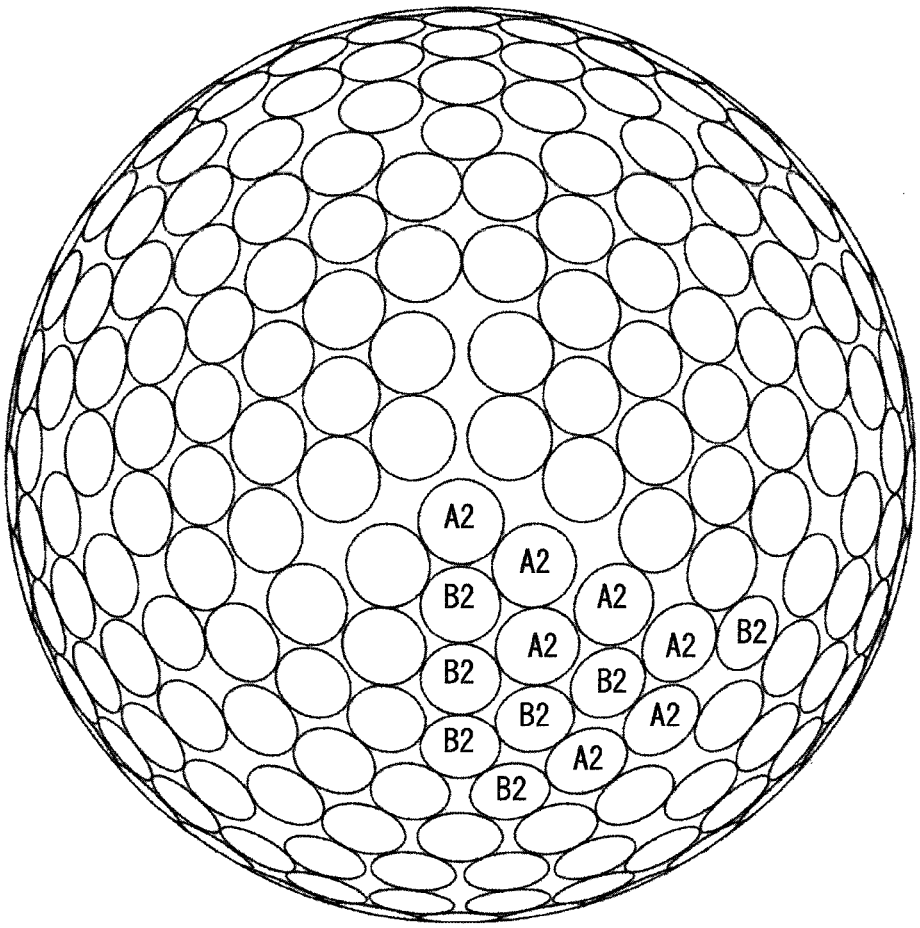
FIG. 13 is a plan view of the golf ball in FIG. 12.
Figure 14:
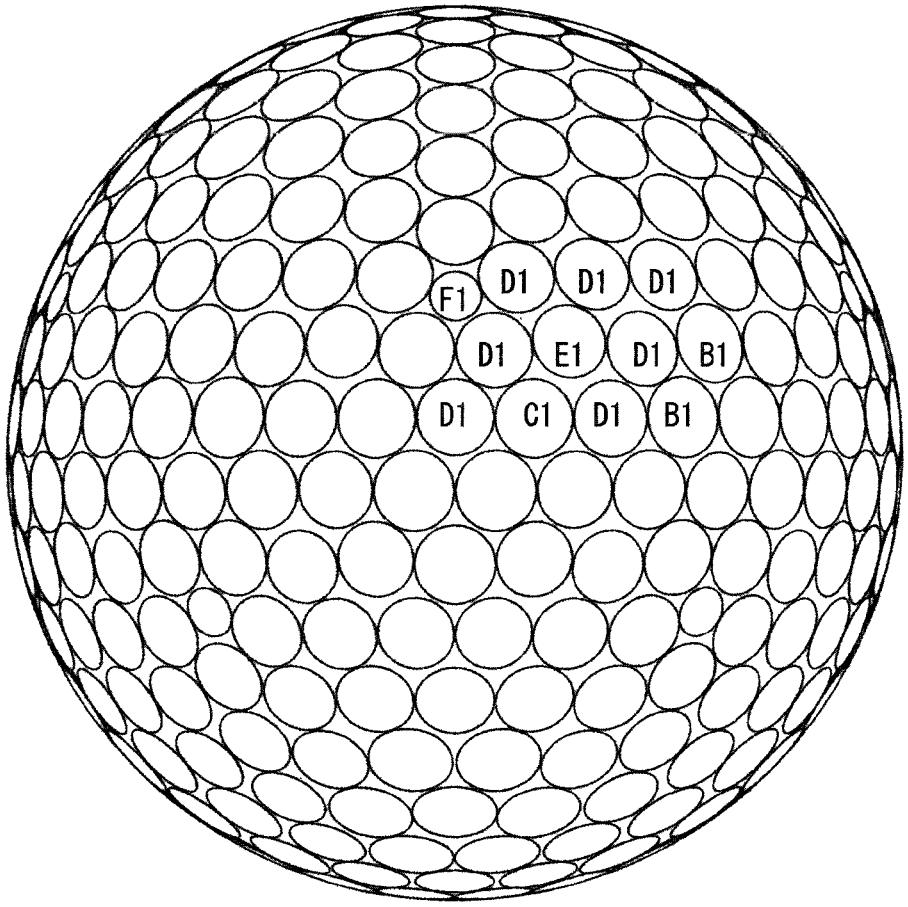
FIG. 14 is a front view of a golf ball according to Comparative Example 5.
Figure 15:
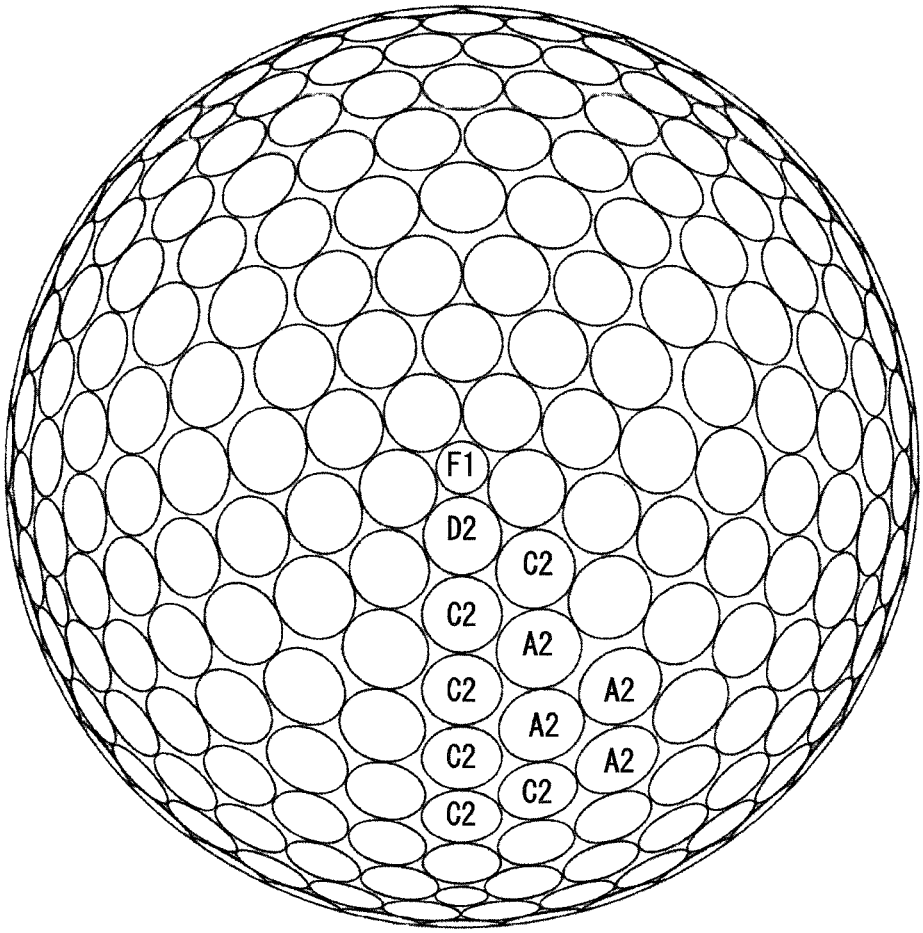
FIG. 15 is a plan view of the golf ball in FIG. 14.
Figure 16:
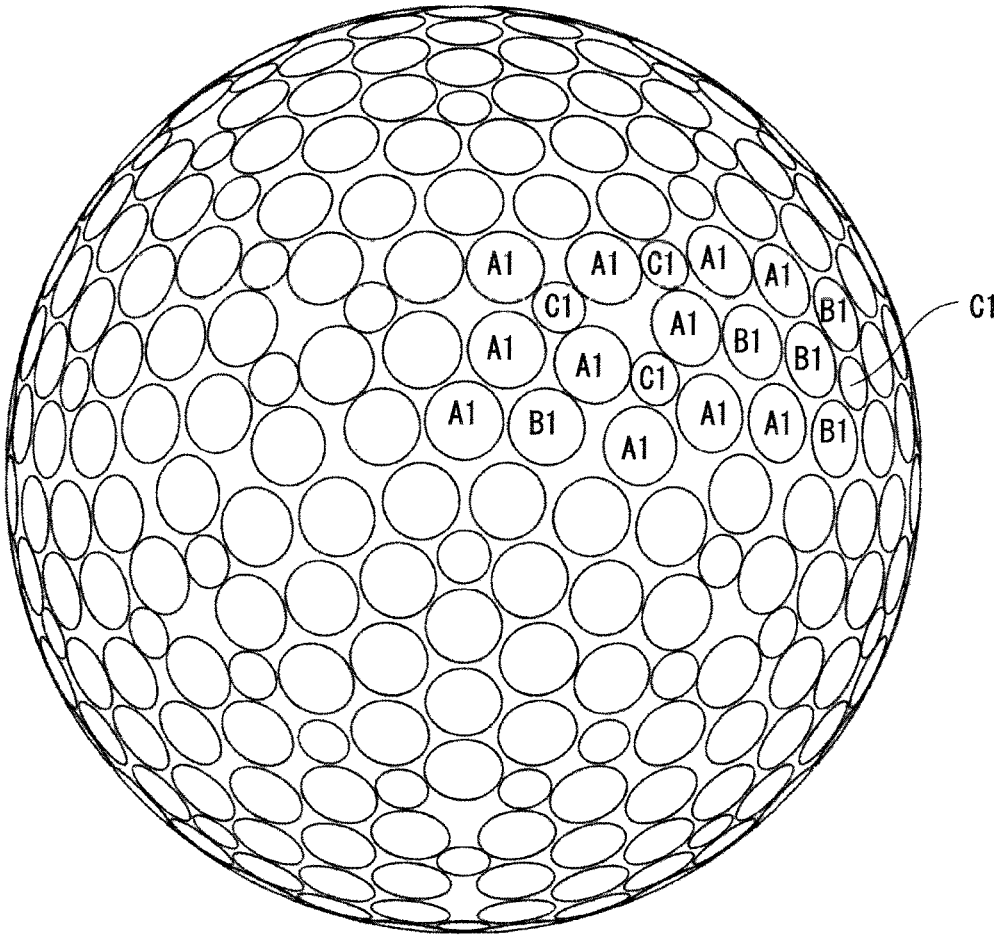
FIG. 16 is a front view of a golf ball according to Comparative Example 6.
Figure 17:
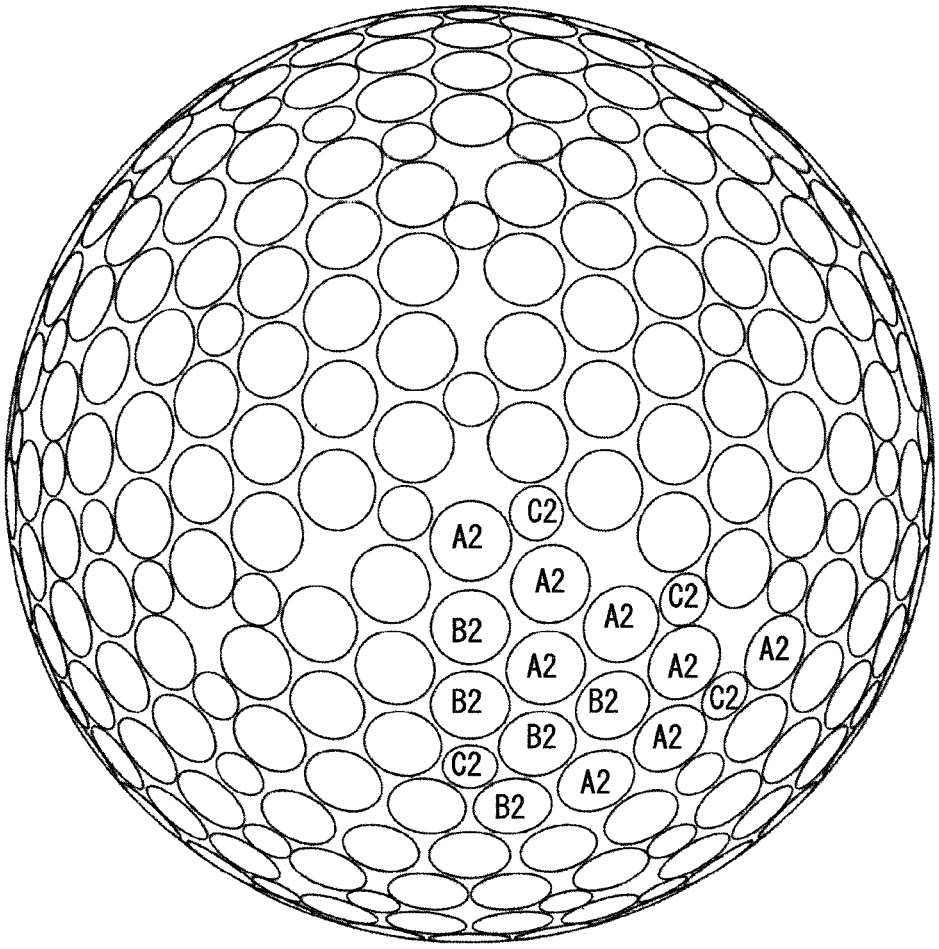
FIG. 17 is a plan view of the golf ball in FIG. 16.

| Results of Evaluation | | | | | |
|---|---|---|---|---|---|
| | Comp. Ex. 2 | Comp. Ex. 3 | Comp. Ex. 4 | Comp. Ex. 5 | Comp. Ex. 6 |
| Core | | | | | |
| Composition | d | b | b | b | b |
| C.T. (° C.) | 160 | 160 | 160 | 160 | 160 |
| Diam. (mm) | 39.4 | 40.6 | 40.2 | 39.8 | 40.2 |
| Df (mm) | 4.0 | 4.8 | 4.8 | 4.8 | 4.8 |
| C0 (Shore C) | 66 | 58 | 58 | 58 | 58 |
| C1 (Shore C) | 78 | 74 | 73 | 72 | 72 |
| Cover | | | | | |
| Composition | B | B | B | B | B |
| T (mm) | 1.65 | 1.05 | 1.25 | 1.45 | 1.25 |
| H (Shore C) | 86 | 86 | 86 | 86 | 86 |
| T * H | 142 | 90 | 108 | 125 | 108 |
| H − C1 | 8 | 12 | 13 | 14 | 14 |
| C1 − C0 | 12 | 16 | 15 | 14 | 14 |
| Dimple | | | | | |
| Type | I | I | V | VI | VII |
| Front view | FIG. 2 | FIG. 2 | FIG. 12 | FIG. 14 | FIG. 16 |
| Plan view | FIG. 3 | FIG. 3 | FIG. 13 | FIG. 15 | FIG. 17 |
| Number N | 338 | 338 | 372 | 422 | 444 |
| So | 0.82 | 0.82 | 0.79 | 0.84 | 0.74 |
| Bb (mm) | 1.40 | 0.80 | 1.01 | 1.21 | 1.02 |
| V | 198 | 346 | 291 | 293 | 322 |
| Bs | 1.39 | 0.79 | 1.00 | 1.22 | 1.01 |
| Bp | 1.42 | 0.82 | 1.02 | 1.21 | 1.03 |
| Speed (m/s) | 57.1 | 56.8 | 56.9 | 57.0 | 56.9 |
| Spin (rpm) | 2720 | 2660 | 2570 | 2500 | 2570 |
| Distance (m) | 196.3 | 195.4 | 195.3 | 195.4 | 194.8 |
| Durability | 110 | 75 | 85 | 75 | 80 |
| Feel at impact | D | A | A | B | A |

As shown in Tables 6 to 8, the golf ball of each Example has excellent durability and excellent feel at impact. From the results of evaluation, advantages of the present invention are clear.

The golf ball according to the present invention is suitable for, for example, playing golf on golf courses and practicing at driving ranges, The above descriptions are merely illustrative examples, and various modifications can be made without departing from the principles of the present invention.

What is claimed is:

1. A two-piece golf ball comprising:

1) a core formed by crosslinking a rubber composition; and 2) a cover formed from a thermoplastic resin composition positioned outside the core, wherein a Shore C hardness C0 at a central point of the core, a Shore C hardness C1 at a surface of the core, and the Shore C hardness H of the cover meet the following mathematical formulas (1), (2), and (3):

$$C1 \geq 70 \quad (1),$$

$$C1 - C0 \geq 10 \quad (2), \text{ and}$$

$$10 \leq H - C1 \leq 20 \quad (3),$$

an amount of compressive deformation Df of the core is equal to or greater than 4.4 mm and equal to or less than 6.5 mm, a nominal thickness T of the cover is equal to or greater than 0.80 mm and equal to or less than 1.45 mm, the golf ball has a plurality of dimples on a surface thereof, and a value V calculated by the following mathematical formula is equal to or greater than 198, but equal to or less than 283, $$V = N * So / Bb$$

wherein N represents a total number of the dimples, So represents a ratio of a total area of all the dimples relative to a surface area of a phantom sphere of the golf ball, and Bb represents an average (mm) of thicknesses B of the cover immediately below deepest points of the dimples, wherein the ratio So is equal to or greater than 0.76 and equal to or less than 0.88, wherein a diameter of the core is equal to or greater than 39.8 mm and equal to or less than 41.0 mm.

2. The two-piece golf ball according to claim 1, wherein an average Bp of the thicknesses B at the dimples that are present in a zone in which a latitude is equal to or greater than 30° is larger than an average Bs of the thicknesses B at the dimples that are present in a zone in which the latitude is less than 30°.

3. The two-piece golf ball according to claim 2, wherein a difference (Bp−Bs) between the average Bp and the average Bs is equal to or greater than 0.010 mm.

4. The two-piece golf ball according to claim 1, wherein a product (T*H) of the nominal thickness T (mm) and a Shore C hardness H of the cover is equal to or less than 150.

5. The two-piece golf ball according to claim 1, wherein the amount of compressive deformation Df of the core is equal to or greater than 4.8 mm.

6. The two-piece golf ball according to claim 1, wherein the ratio So is equal to or greater than 0.82 and equal to or less than 0.88.

* * * * *